US005944279A

United States Patent [19]

Dueck

[11] Patent Number: 5,944,279

[45] Date of Patent: Aug. 31, 1999

[54] APPARATUS FOR CUTTING AND ROLLING SHEET MATERIAL

[76] Inventor: Raymond Dueck, Box 700, Arborg, Manitoba, Canada, R0C 0A0

[21] Appl. No.: 09/164,267

[22] Filed: Oct. 1, 1998

[51] Int. Cl.[6] ..... B65H 35/04

[52] U.S. Cl. ..... 242/527.5; 242/534.1; 242/534.2; 242/563.1; 83/369; 83/364

[58] Field of Search ..... 242/527.5, 534.1, 242/534.2, 527, 526, 523.1, 538.2; 83/369, 364, 361, 367

[56] References Cited

U.S. PATENT DOCUMENTS

| | | | |
|---|---|---|---|
| Re. 28,414 | 5/1975 | Keesling et al. | 242/56 R |
| 2,834,558 | 5/1958 | Halpin | 242/527.5 |
| 3,556,425 | 1/1971 | Keesling et al. | 242/57.1 |
| 3,568,904 | 3/1971 | Kurz | 226/15 |
| 3,643,885 | 2/1972 | Keesling et al. | 242/55 |
| 3,931,940 | 1/1976 | Raighn et al. | 242/56 R |
| 4,120,463 | 10/1978 | Alinder et al. | 242/56 R |
| 4,160,528 | 7/1979 | Malone, Sr. et al. | 242/56 R |
| 4,277,032 | 7/1981 | Alberto et al. | 242/56 R |
| 4,809,921 | 3/1989 | Dueck et al. . | |
| 4,817,882 | 4/1989 | Brewer, Sr. et al. | 242/56 R |

FOREIGN PATENT DOCUMENTS

| | | | |
|---|---|---|---|
| 2428113 | 1/1976 | Germany | 242/534.1 |
| 111186 | 8/1979 | Japan | 83/367 |
| 8203932 | 11/1982 | WIPO | 83/367 |

*Primary Examiner*—Donald P. Walsh
*Assistant Examiner*—Minh-Chau Pham
*Attorney, Agent, or Firm*—Adrian D. Battison; Murray E. Thrift

[57] ABSTRACT

The apparatus for cutting sheet material includes a table in which the sheet material is rolled onto by a unrolling cradle. A re-rolling cradle at a respective side of the table rolls the cut material. An arrangement on the cradles ensures an even roll when unrolling and re-rolling. The re-rolling cradle has a pivotal adjustment about a vertical axis for receiving the material. A measuring arrangement on the apparatus measures the length of sheet to cut at a desired length. The measuring arrangement is automatically calibrated using spaced detectors.

21 Claims, 2 Drawing Sheets

APPARATUS FOR CUTTING AND ROLLING SHEET MATERIAL

FIELD OF THE INVENTION

The present invention relates to apparatus for receiving a rolled sheet material, unrolling a portion of the material, cutting the portion to length and rerolling the cut portion.

BACKGROUND OF THE INVENTION

Devices used for cutting carpet, vinyl flooring and other floor covering materials are known. These devices can be as simple as a rack for supporting a roll of floor covering material adjacent a cutting surface such as a floor or table top. The floor covering material is dispensed from the rack onto the cutting surface and is cut by an individual with a knife. After cutting the floor covering material is manually rerolled. One disadvantage is that if the floor covering material is cut on a floor the floor covering material can be damaged by contact with materials on the floor.

More complex apparatus for performing this task are also known. One example U.S. Pat. No. 4,809,921 (Dueck et al) which includes a cradle of rack for supporting the roll of floor covering material to be dispensed, a table top across which the floor covering material is drawn, and a means of automatically rerolling floor covering material arranged opposite the roll. There components are generally mounted on a frame to keep them raised above the floor at an appropriate height for working. The table top includes a slot running laterally across the table through with a knife blade of a cutter projects. The knife blade and cutter are propelled along the slot by a mechanism which may include a chain which is driven by a sprocket arrangement or a cutter block driven by an air or hydraulic cylinder. When the cutter reaches either of the ends of the slot it contacts a stop which prevents further movement along the slot.

A further problem of existing rolling mechanisms is that the roll of material often does not roll straight causing an angled cut.

Another problem is involved in measuring the desired length of material. The present invention measures the distance and records the distance to continue to make accurate cuts along the material.

SUMMARY OF THE INVENTION

It is one object of the present invention to provide an apparatus for cutting sheet material.

According to the present invention there is provided an apparatus for cutting sheet material comprising:

an unrolling cradle for receiving and unrolling a supply roll of the sheet material, the unrolling cradle being driven such that a front edge of the roll is supplied from the cradle;

a table surface for receiving the sheet from the unrolling cradle such that the sheet passes longitudinally across the table when fed from the unrolling cradle;

a metering wheel arranged to roll on the sheet as it passes from the unrolling cradle and across the table surface for measuring a length of the sheet supplied from the unrolling cradle;

a cutting knife mounted at the table surface and movable transversely across the table surface to slit the sheet at a position along the sheet to form a cut portion of the sheet having a required length;

a rerolling cradle for receiving the front edge and the cut portion and driven to roll the cut portion from the front edge into a roll for supply of the cut portion;

and a metering wheel calibration system comprising:

a first front edge detector mounted in a path of movement of the front edge from the unrolling cradle to the rerolling cradle for detecting passage of the front edge;

a second front edge detector mounted in a path of movement of the front edge from the unrolling cradle to the rerolling cradle for detecting passage of the front edge, the second front edge detector being mounted downstream of the first by a predetermined distance;

and a control unit arranged to receive length measurements from the metering wheel as the front edge passes the first detector and as the front edge passes the second detector to provide a length measurement determined by the metering wheel of the distance therebetween, to compare the length measurement with the predetermined distance and to generate a calibration factor for the metering wheel dependent upon the comparison for application to the measurement of the length of the sheet as it is supplied from the unrolling cradle.

Preferably each of the first and second detectors comprises an electric eye, mounted downstream of the cutting knife on the table surface.

Preferably the metering wheel is mounted closely adjacent and immediately prior to the cutting knife and is arranged to contact one surface of the sheet and there is provided a second metering wheel mounted to contact an opposed surface of the sheet and wherein the control unit is arranged for selection of one of the metering wheels depending upon which provides a more accurate measurement of the length and wherein the control unit automatically selects that metering wheel which provides the more accurate measurement from the comparison.

Preferably there is provided a third front edge detector located at the cutting knife, the control unit being responsive to the third detector for commencing a length measurement for halting drive of the unrolling cradle to stop the front edge at the cutting knife.

According to another aspect of the present invention there is provided:

a first side edge detector arranged adjacent to but separate from the unrolling cradle for detecting a location of one side edge of the sheet as it is supplied from the unrolling cradle;

a second side edge detector arranged adjacent to but separate from the rerolling cradle for detecting a location of one side edge of the sheet as it moves toward the rerolling cradle;

a first support for the unrolling cradle arranged for moving the unrolling cradle in a direction along an axis of the roll thereon for controlling an axial position of the side edge thereof in response to the first side edge detector;

and a second support for the rerolling cradle arranged for twisting the rerolling cradle about a vertical axis so as to change a distance of sides of the rerolling cradle from sides of the table surface in response to the second side edge detector.

Preferably there is provided a third front edge detector located at the cutting knife, the control unit being responsive to the third detector for halting drive of the unrolling cradle to stop the front edge at the cutting knife, the cutting knife being arranged at an end of the table adjacent the unrolling cradle and the first support being moved by the control unit with the front edge stopped at the cutting knife, the rerolling cradle is twisted by a drive actuator, the drive actuator is operated by the control unit.

Preferably the rerolling cradle is mounted on ground wheels oriented to roll on a circle centred on the axis.

According to another aspect of the present invention there is provided:

an unrolling cradle for receiving and unrolling a supply roll of the sheet material, the unrolling cradle being driven such that a front edge of the roll is supplied from the cradle;

a table surface for receiving the sheet from the unrolling cradle such that the sheet passes longitudinally across the table when fed from the unrolling cradle;

a metering wheel arranged to roll on the sheet as it passes from the unrolling cradle and across the table surface for measuring a length of the sheet supplied from the unrolling cradle;

a cutting knife mounted at the table surface and movable transversely across the table surface to slit the sheet at a position along the sheet to form a cut portion of the sheet having a required length;

a rerolling cradle for receiving the front edge and the cut portion and driven to roll the cut portion from the front edge into a roll for supply of the cut portion;

a first side edge detector arranged adjacent to but separate from the unrolling cradle for detecting a location of one side edge of the sheet as it is supplied from the unrolling cradle;

a second side edge detector arranged adjacent to but separate from the rerolling cradle for detecting a location of one side edge of the sheet as it moves toward the rerolling cradle;

a first support for the unrolling cradle arranged for moving the unrolling cradle in a direction along an axis of the roll thereon for controlling an axial position of the side edge thereof in response to the first side edge detector;

and a second support for the rerolling cradle arranged for twisting the rerolling cradle about a vertical axis so as to change a distance of sides of the rerolling cradle from sides of the table surface in response to the second side edge detector.

Preferably there is provided a front edge detector located at the cutting knife and a control unit responsive to the detector for halting drive of the unrolling cradle to stop the front edge at the cutting knife, the cutting knife being arranged at an end of the table adjacent the unrolling cradle and the first support being moved by the control unit with the front edge stopped at the cutting knife.

Preferably the rerolling cradle is twisted by a drive actuator operated by a control unit.

Preferably the rerolling cradle is mounted on ground wheels oriented to roll on a circle centred on the axis and includes a pair of roll pushers each actuable to push the roll generally horizontally, the pushers being spaced along the axis of the roll such that each acts to twist the roll about the vertical axis.

BRIEF DESCRIPTION OF THE DRAWINGS

In the accompanying drawings, which illustrate an exemplary embodiment of the present invention.

DETAILED DESCRIPTION

Figure 1:
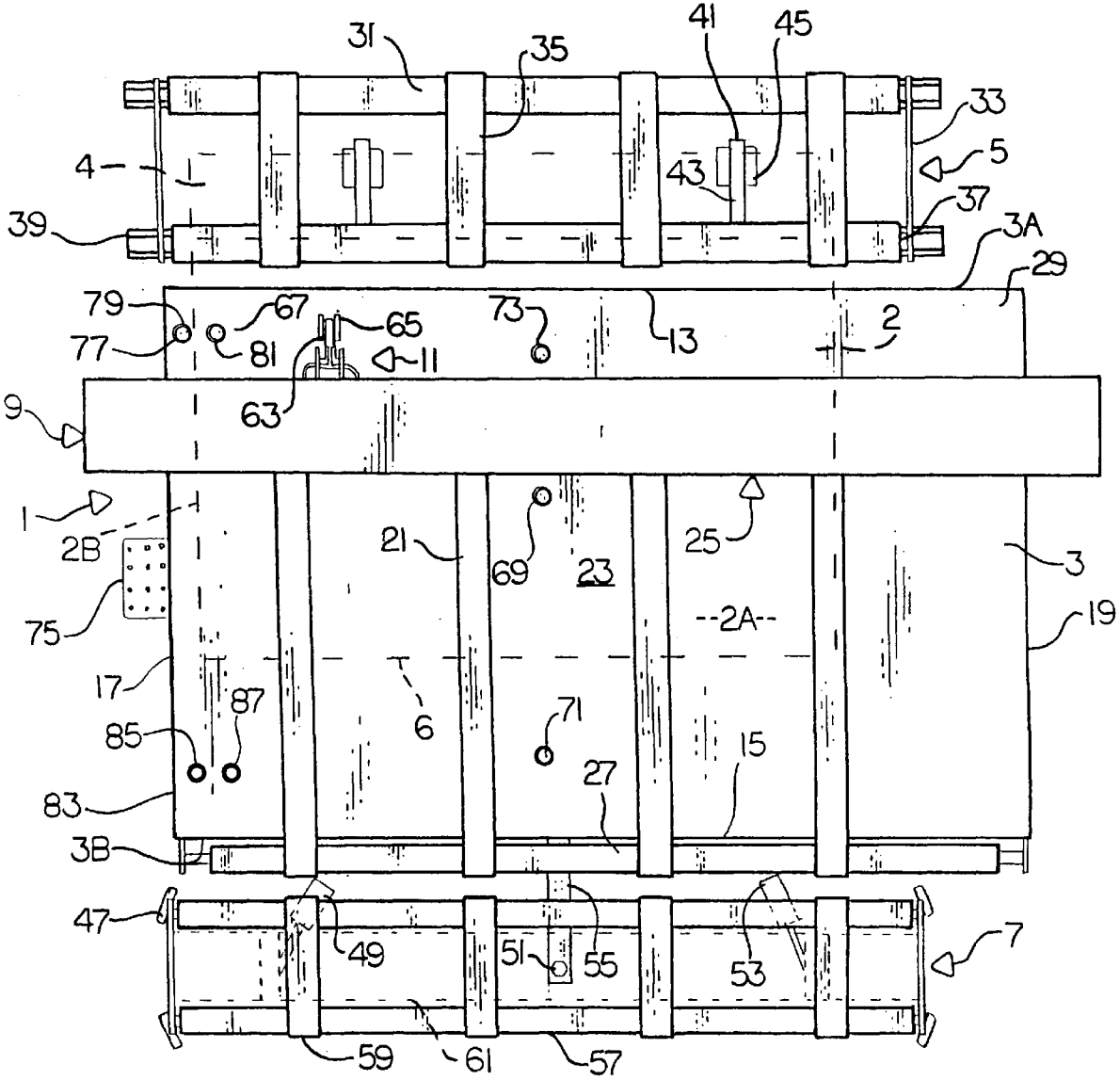
FIG. 1 is a top plan view of the present invention.
Figure 2:
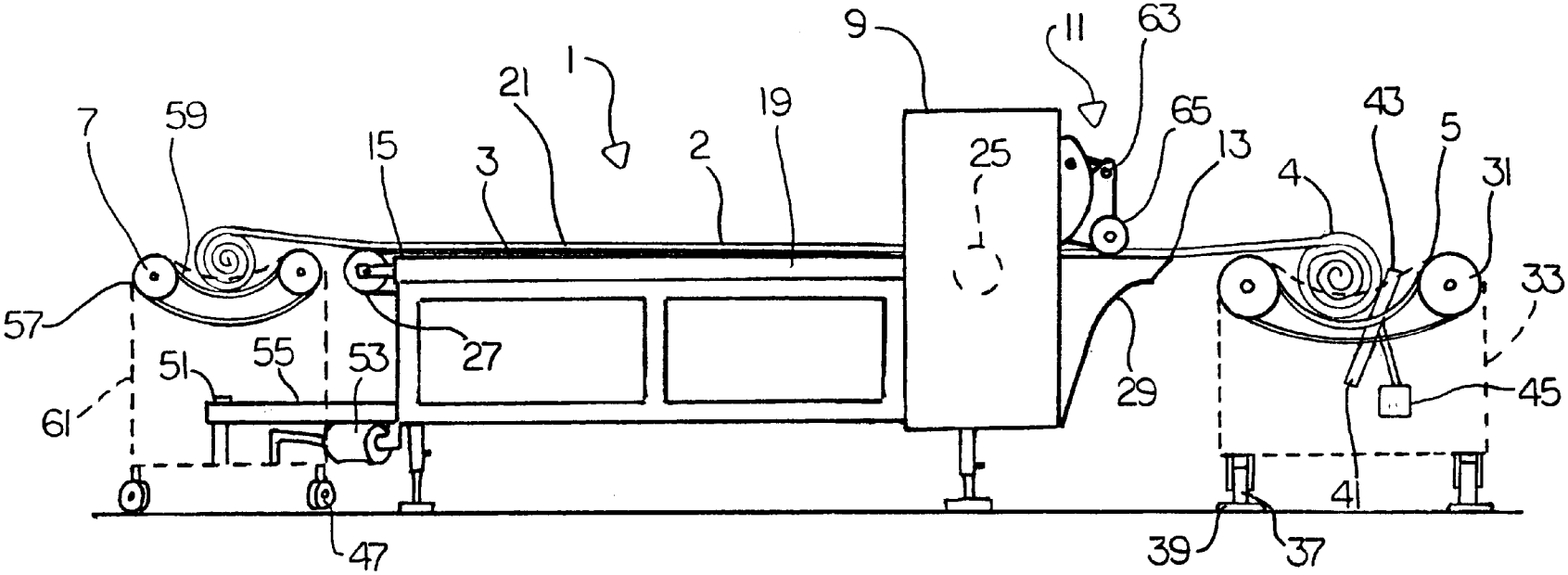
FIG. 2 is a side elevational view of the present invention.

An apparatus for cutting sheet material 1 comprises a table surface 3, an unrolling cradle 5 on a respective side of the table surface 3 for receiving and unrolling a supply roll 4 of sheet material 2, a rerolling cradle 7 on a respective side of the table surface 3 for receiving the sheet material 2, a cutting knife arrangement 9 arranged to cut the sheet material 2 and a measuring arrangement 11 to measure the length of sheet material prior to cutting.

The sheet material 2 has a front edge 6, a side edge 2B and a top surface 2A.

The table surface 3 is arranged to receive the sheet 2 from the unrolling cradle 5 such that the sheet 2 passes longitudinally across the table 3 when fed from the unrolling cradle 5. A first end 13 and a second end 15 being parallel and at respective sides of the table, wherein the unrolling cradle 5 is parallel and adjacent to the first end 13 and wherein the rerolling cradle 7 is parallel and adjacent to the second end 15. A third end 17 and a fourth end 19 are parallel and at respective sides of the table being shorter in length than the first and second ends defining a rectangular shape to the table.

A plurality of belts 21 are arranged to guide the sheet 2 spaced equidistantly apart along the table which run parallel with the third and fourth ends along a flat top side 23 of the table 3 and are driven by a first roller 25 located slightly inward on the table from the first end 13 and a second roller 27 at the furthermost portion of the second end 15. The rollers 25 and 27 are mounted so that the belts 21 run flush with the top side 23 of the table surface 3. Between the first roller 25 and the first end 13 is a receive portion 29.

The cutting arrangement 9 has a cutting knife mounted at the table surface and movable transversely across the table surface to slit the sheet at a position along the sheet to form a cut portion of the sheet having a required length. The cutting knife can be the knife referring to U.S. application Ser. No. 825,939 (Dueck)

The unrolling cradle 5 has a pair of sheet rollers 31 being driven such that a front edge 6 of the roll 4 is supplied from the cradle 5. The sheet rollers 31 have a plurality of roll belts 35 aligned with the belts 21 for guiding the sheet material onto the table, are parallel to the first and second ends of the table and are mounted on a frame 33. The frame 33 has a plurality of ground wheels 37 at respective corners for engaging track 39 which is arranged in a position to allow the unrolling cradle 5 to be adjusted in a direction along an axis of the roll thereon for controlling an axial position of the sheet. The unrolling cradle 5 has a pair of roll pushers 41 having an arm 43 which has an actuator 45 arranged to lift the roll pushers 41 at an incline to guide the roll in a generally horizontal orientation. The unrolling cradle 5 is separate from the table so that the cradle 5 can move side to side for adjustment, as described above.

The rerolling cradle 7 is located on the same side of the table as the second end 15 and is arranged to receive the sheet 2 when passing over the table. The rerolling cradle 7 has a plurality of angled ground wheels 47 which are arranged to enable the cradle to twist about a vertical axis so as to change a distance of sides of the rerolling cradle from sides of the table surface and oriented to roll on a circle centred on the axis. The cradle 7 has a support means 51 at the vertical axis arranged such that the cradle can be driven by a second actuator 49 and a third actuator 53 at respective ends of the cradle 7 being mounted on the frame 61.

The second and third actuators are attached to the table 3 for support when actuating the rerolling cradle. The support means 51 is attached to the table by a horizontal support arm 55 for support when the cradle 7 is twisted by the actuators.

The rerolling cradle 7 has a pair of second parallel sheet rollers 57 having a plurality of second roll belts 59 extending perpendicularly generally parallel with the belts 21 from a respective second roll belt 59 and being equidistantly spaced on the rollers 57 arranged for rerolling the sheet material 2.

The measuring arrangement 11 has a metering wheel 63 mounted closely adjacent and immediately prior to the cutting arrangement 9. The metering wheel 63 is arranged to roll on and contact the surface 2A of the sheet 2 as it passes from the unrolling cradle 5 and across the table 32 for measuring a length of the sheet 2 supplied from the unrolling cradle 5. The metering wheel 63 has a pair of engaging wheels 65 for engaging the sheet 2 in a manner so that the wheels 65 roll freely as the sheet 2 passes.

A metering wheel calibration system, generally indicated at 67, has a first front edge detector 69, defining an electric eye, is mounted in a path of movement of the front edge 6 from the unrolling cradle 5 to the rerolling cradle 7 for detecting passage of the front edge 6. The front edge detector 69 is located on the table surface 3 downstream from the cutting arrangement 9.

A second front edge detector 71, defining an electric eye, is mounted in a path of movement of the front edge 6 from the unrolling cradle 5 to the rerolling cradle 7 for detecting passage of the front edge 6 and is mounted downstream from the first front edge detector 69 by a predetermined distance. The second front edge detector 71 in located on the table surface.

A third front edge detector 73, defining an electric eye, is mounted prior to the cutting arrangement 9 being arranged to halt drive of the unrolling cradle 5 to stop the front edge 6 at the cutting arrangement 9.

A control unit 75 on the third end 17 is arranged to receive length measurements from the metering wheel 63 as the front edge 6 passes the first front edge detector 69 and as the front edge 6 passes the second front edge detector 71 to provide a length measurement determined by the metering wheel 63 of the distance therebetween. The control unit 75 compares the length measurement with the predetermined distance and generates a calibration factor for the metering wheel 63 dependant upon the comparison for application to the measurement of the length of the sheet 2 as it is supplied from the unrolling cradle 7. The control unit 75 automatically selects on of the two engaging wheels 65 which creates the most accurate measurements.

A first side edge detector 77, defining a pair of electric eyes, is arranged adjacent to but separate from the unrolling cradle 7 for detecting a location of one side edge 2B of the sheet 2 as it is supplied from the unrolling cradle 7. The first side edge detector 77 is located prior to the cutting arrangement 9 wherein a first eye 79 detects outward movement of the side edge 2B being located at the outer end of the table. A second eye 81 detects inward movement of the side edge 2B being located slightly inward from the first eye 79 on the table. The first eye 79 and the second eye 81 are at an equal distance from the front end 3A of the table.

A second side edge detector 83, defining a pair of electric eyes, is arranged adjacent to but separate from the rerolling cradle 5 for detecting a location of one side edge 2B of the sheet 2 as it moves toward the rerolling cradle 5. The second side edge detector 83 is located downstream from the cutting arrangement 9 wherein a third eye 85 detects outward movement of the side edge 2B being located at the outer end of the table. A fourth eye 87 detects inward movement of the side edge 2B and is located slightly inward from the third eye 85 on the table. The third eye 85 and the fourth eye 87 are at an equal distance from the rear end 3B of the table.

The control unit 75 receives the measurements from the first side edge detector 77 with the measurements the control unit 75 actuates the unrolling cradle 5 to move in an appropriate side direction to ensure the front edge 6 remains transverse so that the cutting arrangement 9 cuts straight lines.

The control unit 75 receives the measurements from the second side edge detector 83 using the measurements the control unit actuates the actuators 49 and 53 of the rerolling cradle 7 such that the respective actuator twists the rerolling cradle 7 in the appropriate position for an even roll.

While one embodiment of the present invention has been described in the foregoing, it is to be understood that other embodiments are possible within the scope of the invention. The invention is to be considered limited solely by the scope of the appended claims.

I claim:

1. An apparatus for cutting sheet material comprising:

an unrolling cradle for receiving and unrolling a supply roll of the sheet material, the unrolling cradle being driven such that a front edge of the roll is supplied from the cradle;

a table surface for receiving the sheet from the unrolling cradle such that the sheet passes longitudinally across the table when fed from the unrolling cradle;

a metering wheel arranged to roll on the sheet as it passes from the unrolling cradle and across the table surface for measuring a length of the sheet supplied from the unrolling cradle;

a cutting knife mounted at the table surface and movable transversely across the table surface to slit the sheet at a position along the sheet to form a cut portion of the sheet having a required length;

a rerolling cradle for receiving the front edge and the cut portion and driven to roll the cut portion from the front edge into a roll for supply of the cut portion;

and a metering wheel calibration system comprising:

a first front edge detector mounted in a path of movement of the front edge from the unrolling cradle to the rerolling cradle for detecting passage of the front edge;

a second front edge detector mounted in a path of movement of the front edge from the unrolling cradle to the rerolling cradle for detecting passage of the front edge, the second front edge detector being mounted downstream of the first by a predetermined distance;

and a control unit arranged to receive length measurements from the metering wheel as the front edge passes the first detector and as the front edge passes the second detector to provide a length measurement determined by the metering wheel of the distance therebetween, to compare the length measurement with the predetermined distance and to generate a calibration factor for the metering wheel dependent upon the comparison for application to the measurement of the length of the sheet as it is supplied from the unrolling cradle.

2. The apparatus according to claim 1 wherein each of the first and second detectors comprises an electric eye.

3. The apparatus according to claim 1 wherein each of the first and second detectors is mounted on the table surface.

4. The apparatus according to claim 1 wherein each of the first and second detectors is mounted downstream of the cutting knife.

5. The apparatus according to claim 1 wherein the metering wheel is mounted closely adjacent to the cutting knife.

6. The apparatus according to claim 1 wherein the metering wheel is mounted immediately prior to the cutting knife.

7. The apparatus according to claim 1 wherein the metering wheel is mounted so as to contact one surface of the sheet and there is provided a second metering wheel mounted to contact an opposed surface of the sheet and wherein the control unit is arranged for selection of one of the metering wheels depending upon which provides a more accurate measurement of the length.

8. The apparatus according to claim 7 wherein the control unit automatically selects that metering wheel which provides the more accurate measurement from the comparison.

9. The apparatus according to claim 1 wherein there is provided a third front edge detector located at the cutting knife, the control unit being responsive to the third detector for commencing a length measurement.

10. The apparatus according to claim 9 wherein the control unit is responsive to the third detector for halting drive of the unrolling cradle to stop the front edge at the cutting knife.

11. The apparatus according to claim 1 wherein there is provided:

a first side edge detector arranged adjacent to but separate from the unrolling cradle for detecting a location of one side edge of the sheet as it is supplied from the unrolling cradle;

a second side edge detector arranged adjacent to but separate from the rerolling cradle for detecting a location of one side edge of the sheet as it moves toward the rerolling cradle;

a first support for the unrolling cradle arranged for moving the unrolling cradle in a direction along an axis of the roll thereon for controlling an axial position of the side edge thereof in response to the first side edge detector;

and a second support for the rerolling cradle arranged for twisting the rerolling cradle about a vertical axis so as to change a distance of sides of the rerolling cradle from sides of the table surface in response to the second side edge detector.

12. The apparatus according to claim 11 wherein there is provided a third front edge detector located at the cutting knife, the control unit being responsive to the third detector for halting drive of the unrolling cradle to stop the front edge at the cutting knife, the cutting knife being arranged at an end of the table adjacent the unrolling cradle and the first support being moved by the control unit with the front edge stopped at the cutting knife.

13. The apparatus according to claim 11 wherein the rerolling cradle is twisted by a drive actuator.

14. The apparatus according to claim 13 wherein the drive actuator is operated by the control unit.

15. The apparatus according to claim 11 wherein the rerolling cradle is mounted on ground wheels oriented to roll on a circle centered on the axis.

16. An apparatus for cutting sheet material comprising:

an unrolling cradle for receiving and unrolling a supply roll of the sheet material, the unrolling cradle being driven such that a front edge of the roll is supplied from the cradle;

a table surface for receiving the sheet from the unrolling cradle such that the sheet passes longitudinally across the table when fed from the unrolling cradle;

a metering wheel arranged to roll on the sheet as it passes from the unrolling cradle and across the table surface for measuring a length of the sheet supplied from the unrolling cradle;

a cutting knife mounted at the table surface and movable transversely across the table surface to slit the sheet at a position along the sheet to form a cut portion of the sheet having a required length;

a rerolling cradle for receiving the front edge and the cut portion and driven to roll the cut portion from the front edge into a roll for supply of the cut portion;

a first side edge detector arranged adjacent to but separate from the unrolling cradle for detecting a location of one side edge of the sheet as it is supplied from the unrolling cradle;

a second side edge detector arranged adjacent to but separate from the rerolling cradle for detecting a location of one side edge of the sheet as it moves toward the rerolling cradle;

a first support for the unrolling cradle arranged for moving the unrolling cradle in a direction along an axis of the roll thereon for controlling an axial position of the side edge thereof in response to the first side edge detector;

and a second support for the rerolling cradle arranged for twisting the rerolling cradle about a vertical axis so as to change a distance of sides of the rerolling cradle from sides of the table surface in response to the second side edge detector.

17. The apparatus according to claim 16 wherein there is provided a front edge detector located at the cutting knife and a control unit responsive to the detector for halting drive of the unrolling cradle to stop the front edge at the cutting knife, the cutting knife being arranged at an end of the table adjacent the unrolling cradle and the first support being moved by the control unit with the front edge stopped at the cutting knife.

18. The apparatus according to claim 16 wherein the rerolling cradle is twisted by a drive actuator.

19. The apparatus according to claim 18 wherein the drive actuator is operated by a control unit.

20. The apparatus according to claim 16 wherein the rerolling cradle is mounted on ground wheels oriented to roll on a circle centered on the axis.

21. The apparatus according to claim 16 wherein the unrolling cradle includes a pair of roll pushers each actuable to push the roll generally horizontally, the pushers being spaced along the axis of the roll such that each acts to twist the roll about the vertical axis.

* * * * *